US007441940B2

(12) United States Patent
Vanek

(10) Patent No.: US 7,441,940 B2
(45) Date of Patent: Oct. 28, 2008

(54) COLLAPSIBLE MIXING WAND

(75) Inventor: James A. Vanek, Scappoose, OR (US)

(73) Assignee: Sport USA, LLC, Scappoose, OR (US)

( * ) Notice: Subject to any disclaimer, the term of this patent is extended or adjusted under 35 U.S.C. 154(b) by 1035 days.

(21) Appl. No.: 10/692,402

(22) Filed: Oct. 23, 2003

(65) Prior Publication Data

US 2005/0088907 A1 Apr. 28, 2005

(51) Int. Cl.
*B01F 7/00* (2006.01)

(52) U.S. Cl. ..... 366/129; 366/308; 366/343

(58) Field of Classification Search ..... 366/308, 366/343, 129

See application file for complete search history.

(56) References Cited

U.S. PATENT DOCUMENTS 364,059 A * 5/1887 Stauffert ..... 366/285
1,227,671 A * 5/1917 Robertson ..... 416/131
1,436,172 A * 11/1922 Gottfrid et al. ..... 366/251
1,443,738 A * 1/1923 Gibson ..... 366/308
1,711,114 A * 4/1929 Hunt ..... 416/142
1,734,120 A * 11/1929 Farrington ..... 366/308
1,827,004 A * 10/1931 Gibson ..... 366/308
2,859,020 A * 11/1958 Eddy et al. ..... 366/274
2,896,926 A * 7/1959 Chapman ..... 416/66
3,223,389 A * 12/1965 Simmonds ..... 366/282
3,455,540 A * 7/1969 Marcmann ..... 416/142
3,559,962 A * 2/1971 Enssle et al. ..... 366/308
4,060,224 A * 11/1977 Wilson ..... 366/169.1
4,083,653 A * 4/1978 Stiffler ..... 416/142
4,092,984 A * 6/1978 Bindel ..... 604/156
4,095,919 A * 6/1978 Ehrenskjold et al. ..... 416/142
4,355,906 A * 10/1982 Ono ..... 366/274
4,396,291 A * 8/1983 Simmonds ..... 366/282
4,656,997 A * 4/1987 Morales-George ..... 128/897
4,872,764 A * 10/1989 McClean ..... 366/251
4,981,367 A * 1/1991 Brazelton ..... 366/308
5,192,131 A * 3/1993 Hatfield ..... 366/308
5,489,151 A * 2/1996 Weber ..... 366/247
5,676,463 A * 10/1997 Larsen ..... 366/251
5,885,001 A * 3/1999 Thomas ..... 366/308
5,941,636 A * 8/1999 Lu ..... 366/249
6,094,999 A * 8/2000 DuBois ..... 73/864.64
6,247,837 B1 * 6/2001 Wardberg ..... 366/129
6,419,385 B1 * 7/2002 Walls ..... 366/247

* cited by examiner

*Primary Examiner*—Tony G Soohoo
(74) *Attorney, Agent, or Firm*—Robert D. Varitz, PC

(57) ABSTRACT

A collapsible mixing wand includes an elongate shaft having a longitudinal axis therealong, a free end and a mixer attachment end; a mixer assembly attached to the elongate shaft at the mixer attachment end thereof by a fixing mechanism, for rotation relative to the longitudinal axis; wherein, when the elongate shaft is rotated in a first direction, the mixer assembly rotates to an extended condition; and when the elongate shaft rotates in a second direction, the mixer assembly rotates to a substantially collapsed condition.

6 Claims, 3 Drawing Sheets

Fig. 8
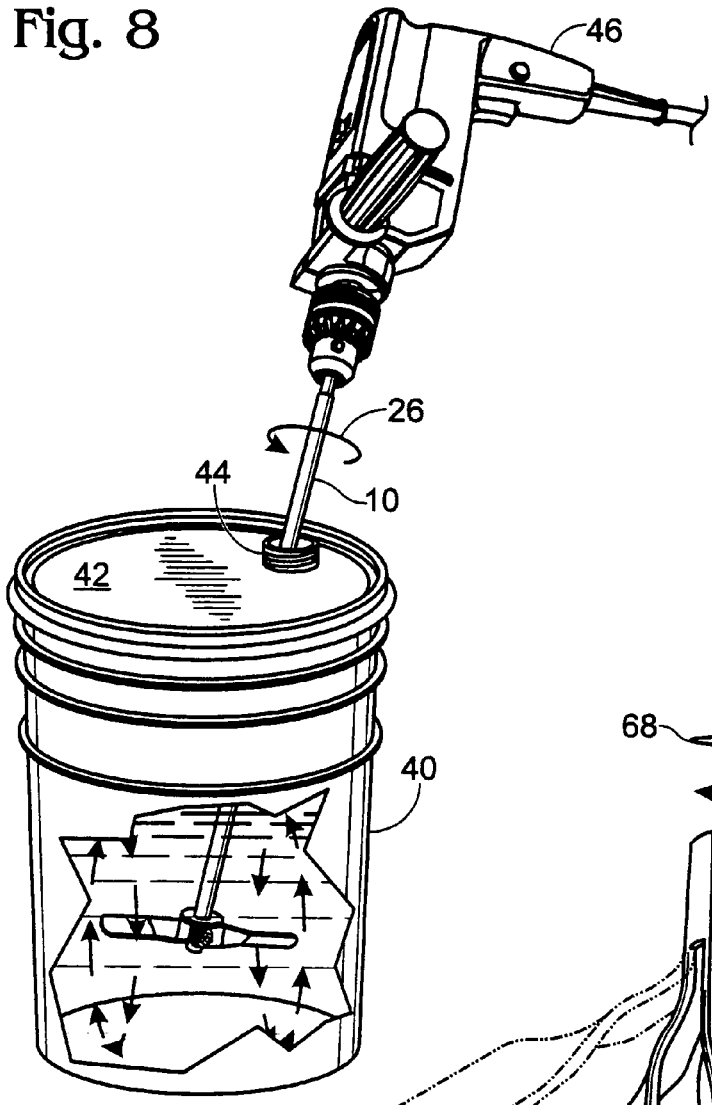
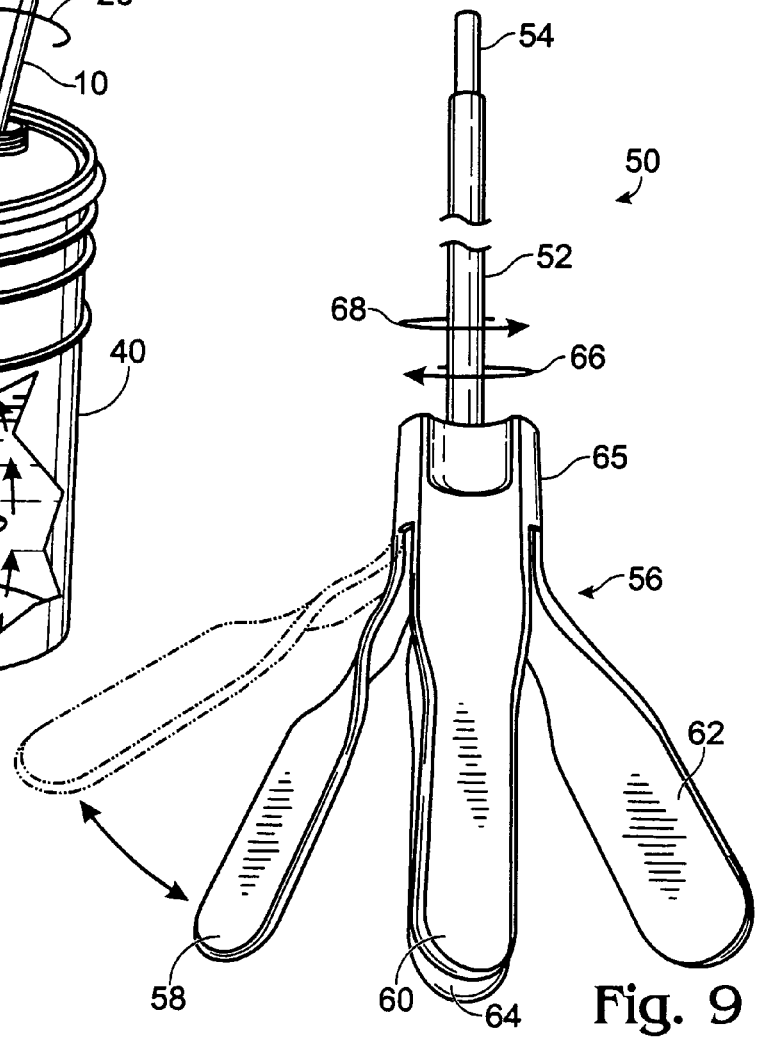
Fig. 9

COLLAPSIBLE MIXING WAND

FIELD OF THE INVENTION

This invention relates to mixing apparatus, and specifically to a mixing wand which is insertable through a pour spout on a container of material to be mixed.

BACKGROUND OF THE INVENTION

There exist a large number of devices which may be used to mix materials. Most such materials are some form of fluid having a suspension of solid particles therein, where the solid particle tend to drop out of suspension, collecting at the bottom of the container, and leaving a substantially liquid material at the top of the container. Paint is a good example of such a material. Prior art mixers for stirring paint to re-suspend the solid particles include everything from a paint paddle, i.e., a flat piece of wood, plastic or metal, which is used to manually stir paint; to complex mixers which are stand-alone devices, and which may receive a container of paint therein and which mix the paint by oscillating actions; to egg-beater type appliances which stir paint with a hook or propeller blade mixing implement. Paint may be supplied in containers sized from one pint to fifty-five gallon containers.

Other materials which need to be mixed prior to use include sauces and salad dressing used in the food industry. Such items are generally delivered to restaurants in five to fifty-five gallon drums.

Concrete may be supplied in dry form in fifty-five gallon drums, which require the mixing of water with the concrete to form a usable product.

SUMMARY OF THE INVENTION

A collapsible mixing wand includes an elongate shaft having a longitudinal axis therealong, a free end and a mixer attachment end; a mixer assembly attached to the elongate shaft at the mixer attachment end thereof by a fixing mechanism, for rotation relative to the longitudinal axis; wherein, when the elongate shaft is rotated in a first direction, the mixer assembly rotates to an extended condition; and when the elongate shaft rotates in a second direction, the mixer assembly rotates to a substantially collapsed condition.

This summary and objectives of the invention are provided to enable quick comprehension of the nature of the invention. A more thorough understanding of the invention may be obtained by reference to the following detailed description of the preferred embodiment of the invention in connection with the drawings.

BRIEF DESCRIPTION OF THE DRAWINGS

FIG. 8 depicts the mixing wand of the invention in an operable condition in a container having material therein to be mixed, with portions of the container broken away to show details.

FIG. 9 is a side elevation of a third embodiment of the mixing wand of the invention, depicting mixing blades in a collapsed condition.

DETAILED DESCRIPTION OF THE PREFERRED EMBODIMENTS

Figure 1:
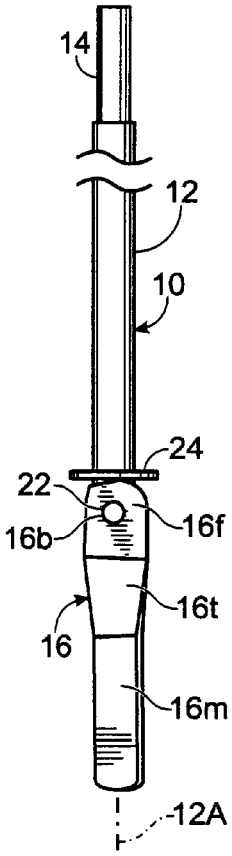
FIG. 1 is a side elevation of the collapsible mixing wand of the invention, depicted in a collapsed condition.
Figure 2:
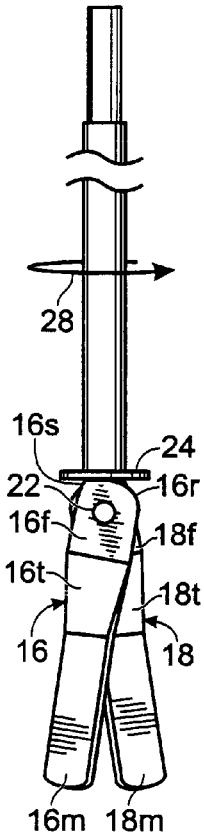
FIG. 2 is a side elevation of the mixing wand of the invention, depicting mixing blades in a reversed mixing condition.
Figure 3:
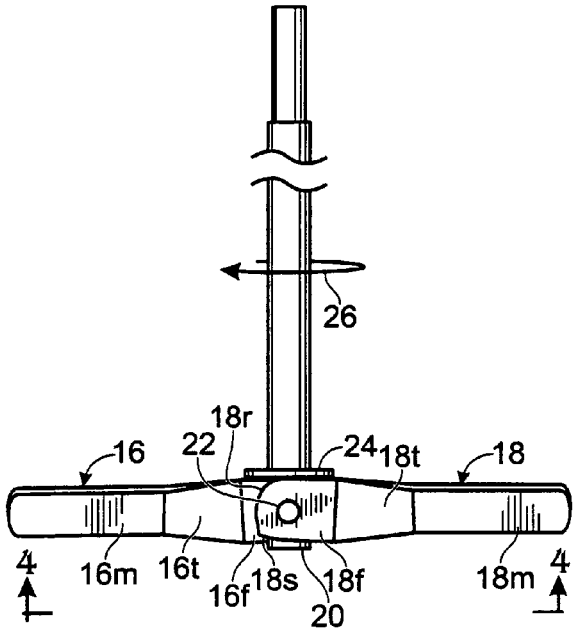
FIG. 3 is a side elevation of a second embodiment of the mixing wand of the invention, depicting mixing blades in an extended condition.
Figure 4:
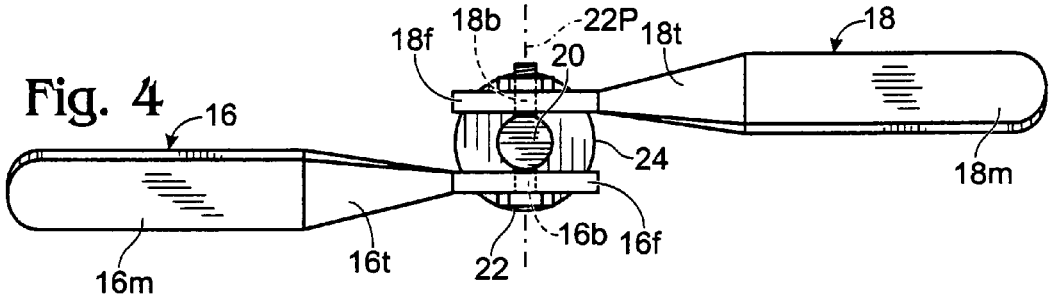
FIG. 4 is a bottom plan view of the mixing wand of FIG. 3, depicting mixing blades in an extended condition.
Figure 5:
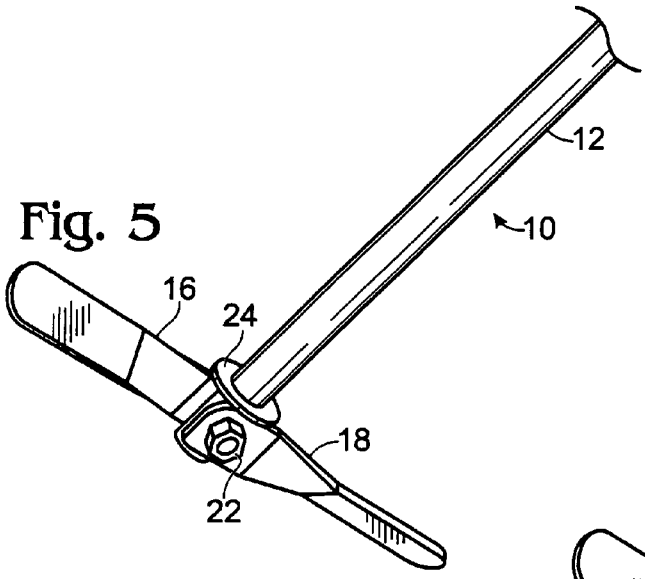
FIG. 5 is an isometric view of the collapsible mixing wand of the invention.

Referring initially to FIGS. 1-5, a first embodiment of the collapsible mixing wand of the invention is shown generally at 10. Wand 10 includes a shaft 12, having a longitudinal axis 12A, and a reduced diameter portion 14 at the upper, one end thereof. Reduced diameter portion 14 is provided to allow insertion of shaft 12 into a power head, such as a power drill. The power drill used with wand 10 is preferably of the variable speed, reversible drive type, for reasons which will be explained later herein. The other end of shaft 12 may be formed to have opposing flat surfaces thereon, for affixing a pair of blades thereto. or may be left cylindrical, as shown in FIG. 4.

In the preferred embodiment, a pair of elongate blades 16, 18, referred to herein as a mixer assembly, are rotatably fixed to other, or mixer attachment, end 20 of shaft 12. A fixing mechanism 22 is preferably a nut-and-bolt combination of the aircraft type, wherein the nut locks in place on the bolt such that blades 16 and 18 may freely rotate about a pivot point 22P defined by the center of fixing mechanism 22. Other forms of fixing mechanism 22 may include rivets, bolt-and-cap nuts, etc. Blades 16, 18 have a flat portion 16*f*, 18*f*, respectively, at one end thereof, which includes bores 16*b*, 18*b*, which receive fixing mechanism therethrough. Each blade has a twist intermediate the ends thereof, shown at 16*t*, 18*t*, respectively, which results in the other end of each blade, also referred to herein as the mixing portion, 16*m*, 18*m*, having a plane which is offset from the plane of the flat portion by approximately forty-five degrees.

A mixer stop 24 is located adjacent the other end of shaft 12 to limit rotation of blades 16, 18 to no more than 90° relative to the longitudinal axis 12A of shaft 12, as shown in FIGS. 3 and 4. Stop 24 may be fixed to shaft 12 as by welding, or may be machined into shaft 12 during fabrication thereof. Blades 16 and 18 are provided with a rounded edge, 16*r*, 18*r*, at one side thereof to allow free swinging of the blade past stop 24. The other side of blades 16, 18, is substantially squared, 16*s*, 18*s*, to substantially prevent movement of blades 16, 18 past a substantially parallel condition relative to axis 12A. as shown in FIG. 2. The mixer assembly may use only a single blade in some application, with modification of stop 24 to facilitate use of a single blade.

Blades 16, 18 are fastened to shaft 12 other end so that, when shaft 12 is rotated in the direction of arrow 26, a first direction, the blades rotate outward to an extended condition, as shown in FIG. 3. The outward movement of blades 16, 18 is the result of centrifugal force on the blades, and is also the result of the resistance of the material being mixed on blade mixing portions 16*m*, 18*m*. This rotation causes the material being mixed which is located proximal to the mixing assembly to be directed downwards in a mixing container, which draws any admix placed at the top of the material to be drawn down into the container, and also causes heavy solids at the bottom of the mixing container to be pushed outwards towards the mixing container sidewall(s) and pushed upwards along the sidewall(s).

When shaft 12 is rotated in the direction of arrow 28, the blades rotate to a substantially collapsed condition, substantially parallel to axis 12A, as shown in FIG. 2, as a result of the resistance of the material being mixed on blade mixing portions 16*m*, 18*m*. The ends of blades 16, 18, on mixing portions 16*m*, 18*m*, are rounded and smoothed. This configuration prevents the blades from damaging the sides of containers, such as plastic containers, when the mixing wand is used to mix the contents thereof. In the preferred embodiment, the mixing wand, with the mixing assembly collapsed, has a diameter of approximately 1.25 inches. Various length blades may be provided, to provide a mixing assembly of 7.25 inches plus when the blades are in their extended condition.

Figure 6:
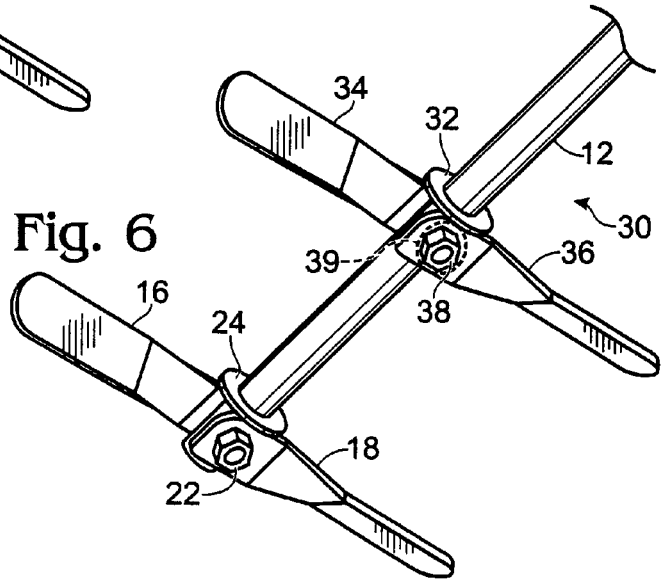
FIG. 6 is an isometric view of a second embodiment of the mixing wand of the invention.

Variations of this embodiment of the invention include placement of three or four blades in a mixing assembly at a single location on a shaft, and also includes placement of blades at the other end of shaft 12 and intermediate the ends thereof, as shown in FIG. 6, wherein a mixing wand 30 includes the features of mixing wand 10, and further includes a second mixing assembly, having a stop 32, and blades 35, 36, attached to the wand by fixing mechanism 38. This latter embodiment is particularly useful when the mixing wand is to be used in large drums, such as in fifty-five gallon drums. Any configuration of the mixing wand of the invention may be formed of stainless surgical steel, such as 316 L stainless, for use with products intended for human or animal consumption.

Figure 7:
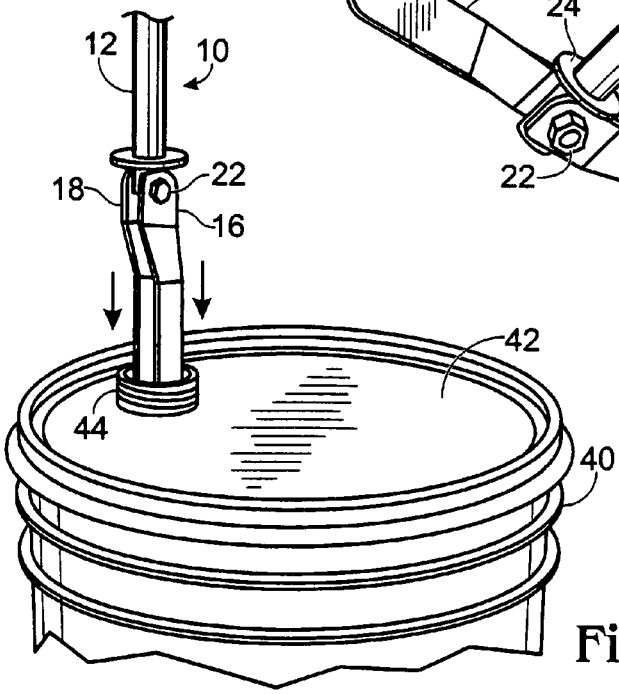
FIG. 7 depicts insertion of the mixing wand of the invention into a container having material therein to be mixed.

Turning now to FIG. 7, a container 40 has a lid 42, having a pour spout 44 thereon. Mixing wand 10 is depicted with the blades thereof in a collapsed condition, which allows the blades and shaft to fit through pour spout 44. This allows mixing of the contents of container 40 without having to remove lid 42. Although removing lid 42 is a trivial matter, removal of the lid facilitates a massive spill at worst, and, at a minimum, results in splatters of the contents of the container, neither of which is desirable. The ability to mix the container contents, as shown in FIG. 8, wherein a power drill 46 is attached to wand 10, with the lid in place is a much less hazardous event. Being able to mix the contents of air-sensitive materials, such as epoxy resins and some paints, without removal of lid 42 provides a longer mixed-life period for such compounds. Wand 10 and the variations thereof may also be used to mix concrete, provided that a sufficiently powerful power head is applied, and the mixing speed is kept low. To this end, drill 46 should be of the variable speed, i.e., 500 RPM to 2000 RPM, reversible type. Pour spouts typically used on paint containers and the like have an industry standard inside diameter of between about 1.25 inches and 1.75 inches, which easily accommodates a clearance fit of the 1.25 inch diameter of the preferred embodiment of the collapsed mixing assembly.

Another embodiment of the mixing wand of the invention is depicted in FIG. 9 at 50. In this embodiment, a shaft 52 has a free end 54 and has a polymer blade set 56 fixed to the other end thereof. Blade set 56 is formed of PVC-type polymer as a unitary, integrally formed structure. In this embodiment, the blades 58, 60, 62 and 64, of the mixing assembly are formed with a hub 65, and include a twist intermediate the hub and the free ends thereof. As in the case of the first embodiment, when shaft 52 is rotated in the direction of arrow 66, the blades extend under centrifugal force and as a result of resistance from the material being mixed. When shaft 52 is rotated in the direction of arrow 68, the blades collapse to a relaxed position, which is suitable for low speed mixing, and, when shaft rotation is stopped, for entry and exit from the pour spout of a container. This embodiment may be manufactured in a variety of sizes, and may be used with small containers, such a one pint or one quart containers, which may have pour spouts smaller than those used on larger containers. As with any of the embodiments of the mixing wand of the invention, cleanup is accomplished by placing the mixing assembly in a container of solvent and causing the elongate shaft to rotate, being careful to avoid splashing the solvent onto the surrounding areas.

Thus, a collapsible mixing wand has been disclosed. It will be appreciated that further variations and modifications thereof may be made within the scope of the invention as defined in the appended claims.

I claim:

1. A collapsible mixing wand comprising:

an elongate shaft having a longitudinal axis therealong, a free end and a mixer attachment end;

a mixer assembly attached to said elongate shaft at the mixer attachment end thereof by a fixing mechanism, for rotation relative to said longitudinal axis, wherein said mixer assembly includes a flexible polymer blade set having plural, integrally formed blades, and wherein each blade has a twist intermediate an attachment end which is attached to a blade set hub and a free end;

wherein, when said elongate shaft is rotated in a first direction, said mixer assembly rotates to an extended condition; and when said elongate shaft rotates in a second direction, said mixer assembly rotates to a substantially collapsed condition.

2. The collapsible mixing wand of claim 1 wherein said elongate shaft includes a reduced diameter portion at the free end thereof for attachment of a power head.

3. The collapsible mixing wand of claim 1 wherein said mixing assembly is sized with a diameter to be clearance fittable through an industry standard pour spout of a mixing container.

4. A collapsible mixing wand comprising:

an elongate shaft having a longitudinal axis therealong, a free end and a mixer attachment end;

a mixer assembly attached to said elongate shaft at the mixer attachment end thereof by a fixing mechanism, for rotation relative to said longitudinal axis, wherein said mixer assembly includes a flexible polymer blade set having plural, integrally formed blades, wherein said mixing assembly includes a least four elongate blades having a twist intermediate the ends thereof, disposed on said mixer attachment end;

wherein, when said elongate shaft is rotated in a first direction, the blades of said mixer assembly flex outwardly, rotating to an extended condition; and when said elongate shaft rotates in a second direction, the blades of said mixer assembly flex inwardly, rotating to a substantially collapsed condition.

5. The collapsible mixing wand of claim 4 wherein said elongate shaft includes a reduced diameter portion at the free end thereof for attachment of a power head.

6. A collapsible mixing wand for mixing material in a container, the container having a lid with an industry standard pour spout, comprising:

an elongate shaft having a longitudinal axis therealong, a free end having a reduced diameter portion for attachment of a power head, and a mixer attachment end;

a mixer assembly attached to said elongate shaft at the mixer attachment end thereof by a fixing mechanism, for rotation relative to said longitudinal axis, and sized to clearance fit through an industry standard pour spout when in a collapsed condition, wherein said mixer assembly includes a flexible PVC polymer blade set having plural, integrally formed blades, wherein each blade has a twist intermediate an attachment end which is attached to a blade set hub and a free end, wherein rotation of said mixer assembly causes flexing of said flexible PVC polymer blades;

wherein, when said elongate shaft is rotated in a first direction, said mixer assembly rotates to an extended condition and exerts a downward force on the material in the container located proximal to said mixing assembly; and when said elongate shaft rotates in a second direction, said mixer assembly rotates to a substantially collapsed condition.

* * * * *